US008197057B2

(12) United States Patent
Miyazawa

(10) Patent No.: US 8,197,057 B2
(45) Date of Patent: Jun. 12, 2012

(54) PRINTING APPARATUS AND PRINTING METHOD

(75) Inventor: Hiroshi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

(21) Appl. No.: 12/407,033

(22) Filed: Mar. 19, 2009

(65) Prior Publication Data

US 2009/0244241 A1 Oct. 1, 2009

(30) Foreign Application Priority Data

Mar. 27, 2008 (JP) ..... 2008-082861
Dec. 18, 2008 (JP) ..... 2008-321906

(51) Int. Cl.
*B41J 2/01* (2006.01)

(52) U.S. Cl. ..... 347/104; 347/103; 101/230

(58) Field of Classification Search ..... 347/103, 347/104, 101; 101/230, 232; 400/659, 23
See application file for complete search history.

(56) References Cited

U.S. PATENT DOCUMENTS 4,378,734 A * 4/1983 Wirz ..... 101/230
6,438,352 B1 * 8/2002 Landa et al. ..... 101/230
7,287,750 B2 * 10/2007 Boguhn et al. ..... 271/275
2007/0236535 A1 * 10/2007 Baker et al. ..... 347/104

FOREIGN PATENT DOCUMENTS

| | | |
|---|---|---|
| JP | 06-191060 | 7/1994 |
| JP | 10-235849 | 9/1998 |
| JP | 10-278312 | 10/1998 |
| JP | 2005-205912 | 8/2005 |
| JP | 2006-044024 | 2/2006 |
| JP | 2006-130830 | 5/2006 |

* cited by examiner

*Primary Examiner* — Manish S Shah
(74) *Attorney, Agent, or Firm* — Workman Nydegger

(57) ABSTRACT

A printing apparatus includes a rotating drum that holds a recording medium on a cylindrical outer peripheral surface thereof and rotates around a rotating shaft, and a printing head that is disposed opposite to the outer peripheral surface of the rotating drum and ejects ink onto the recording medium held on the rotating drum to perform a printing operation. The rotating drum holds a first recording medium and a second recording medium arranged in a rotating direction. A distance between a rotating direction downstream end of the first recording medium and a rotating direction upstream end of the second recording medium is larger than a distance between a rotating direction downstream end of the second recording medium and a rotating direction upstream end of the first recording medium.

2 Claims, 5 Drawing Sheets

PRINTING APPARATUS AND PRINTING METHOD

BACKGROUND

1. Technical Field

The present invention relates to a printing apparatus and a printing method, and more particularly, to a printing apparatus and a printing method of performing a printing operation by ejecting ink onto a recording medium held on a rotating drum.

2. Related Art

A printing apparatus rotates a rotating drum once or more with a recording medium absorbed to a peripheral surface of the rotating drum, and transports the recording medium to a position opposite to a printing head a plurality of times. In the printing apparatus, every when the rotating drum is rotated once with the recording medium held on the rotating drum, positions of ink dots formed on the recording medium are shifted in a rotating direction or width direction of the rotating drum by a predetermined pitch smaller than a pitch of nozzles. Accordingly, the ink dots become dense, thereby obtaining high resolution.

JP-A-10-235849 is an example of related art.

In the printing apparatus, while a sheet of recording medium is rotated once or more by the rotating drum, the printing operation cannot be performed on the subsequent recording medium. Accordingly, when a printing operation is continuously performed on a plurality of sheets, a throughput decreases.

SUMMARY

An advantage of some aspects of the invention is to improve a throughput of a continuous printing operation performed on a plurality of sheets, when a recording medium is rotated once or more by a rotating drum and is transported to a position opposite to a printing head a plurality of times.

According to an aspect of the invention, a printing apparatus includes: a rotating drum that holds a recording medium on a cylindrical outer peripheral surface thereof and rotates around a rotating shaft; and a printing head that is disposed opposite to the outer peripheral surface of the rotating drum and ejects ink onto the recording medium held on the rotating drum to perform a printing operation, and the rotating drum holds a plurality of recording mediums arranged in a rotating direction on the outer peripheral surface. With such a configuration, while the rotating drum rotates a recording medium first transported to the rotating drum and printed by the printing head, a subsequent recording medium is transported to a position opposite to the printing head by the rotating drum to perform a printing operation on the recording medium. Accordingly, when the recording medium is rotated once or more and is transported to the position opposite to the printing head a plurality of times, it is possible to improve a throughput of a continuous printing operation performed on a plurality of sheets. When a curvature of the outer peripheral surface of the rotating drum is made low to prevent the recording medium from being detached from the rotating drum by reaction force of the recording medium, a circumferential length of the outer peripheral surface is extended. However, according to the printing apparatus, the recording medium is held in the extended space of the outer peripheral surface, and thus it is possible to effectively use the extended space of the outer peripheral surface.

In the printing apparatus, it is preferable that the rotating drum transports the recording medium to the position opposite to the printing head a plurality of times, the printing head is provided with a plurality of nozzle rows, which is formed of a plurality of nozzles arranged in a direction of the rotating shaft of the rotating drum, in a rotating direction of the rotating drum, and ink is ejected to the re-transported recording medium to the position opposite to the rotating drum, so as to be shifted from ink dots formed in the previous printing operation in the rotating direction of the rotating drum. With such a configuration, the ink dots become dense to improve resolution, and it is possible to improve a throughput of a continuous printing operation of a plurality of sheets.

In the printing apparatus, it is preferable that a drying portion for drying ink attached to the recording medium is provided at a position opposite to the printing head with the rotating drum therebetween. With such a configuration, a distance from the printing head to the drying portion along the rotating direction of the rotating drum is as long as possible. Accordingly, it is possible to prevent a temperature around the printing head from being raised by heat emitted from the drying portion, and to prevent the nozzles from being clogged by drying of ink in the printing head.

In the printing apparatus, it is preferable that the rotating drum holds a first recording medium and a second recording medium as the plurality of recording mediums, a distance between a rotating direction downstream end of the first recording medium and a rotating direction upstream end of the second recording medium is larger than a distance between a rotating direction downstream end of the second recording medium and a rotating direction upstream end of the first recording medium, and an ink receiving portion that receives ink preliminarily ejected from the printing head is provided between the rotating direction downstream end of the first recording medium and the rotating direction upstream end of the second recording medium. With such a configuration, it is not necessary to interrupt the printing operation while the printing head performs a preliminary ejecting operation. Accordingly, it is possible to improve a throughput of a continuous printing operation of a plurality of sheets. In addition, since the distance between the rotating direction downstream end of the first recording medium and the rotating direction upstream end of the second recording medium can be reduced as much as a space for installing the ink receiving portion is unnecessary, the circumferential length of the rotating drum can be reduced. Accordingly, it is possible to reduce the size of the rotating drum.

In the printing apparatus, it is preferable that the rotating drum is provided with a pair of holding portions pinching leading ends of the first recording medium and the second recording medium in cooperation with the outer peripheral surface, each of the pair of holding portions is provided with a shaft member disposed on the inner peripheral side of the outer peripheral surface, a plurality of pawl members swingably supported to the shaft member and arranged along a width direction of the rotating drum, and end portions of the plurality of pawl members protrude from holes formed on the outer peripheral surface out of the rotating drum, are bent toward the rotating direction upstream side of the rotating drum, and are urged toward the rotating direction upstream side of the rotating drum. With such a configuration, it is possible to hold and release a plurality of recording mediums with a simple configuration.

The above-described outline does not enumerate all characteristics of the invention. Sub-combination with such characteristics can be applied to the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described hereinafter with reference to embodiment, but the invention is not limited to the following embodiments. All combinations of characteristics described in the embodiments are not essential for resolution means of the invention.

Figure 1:
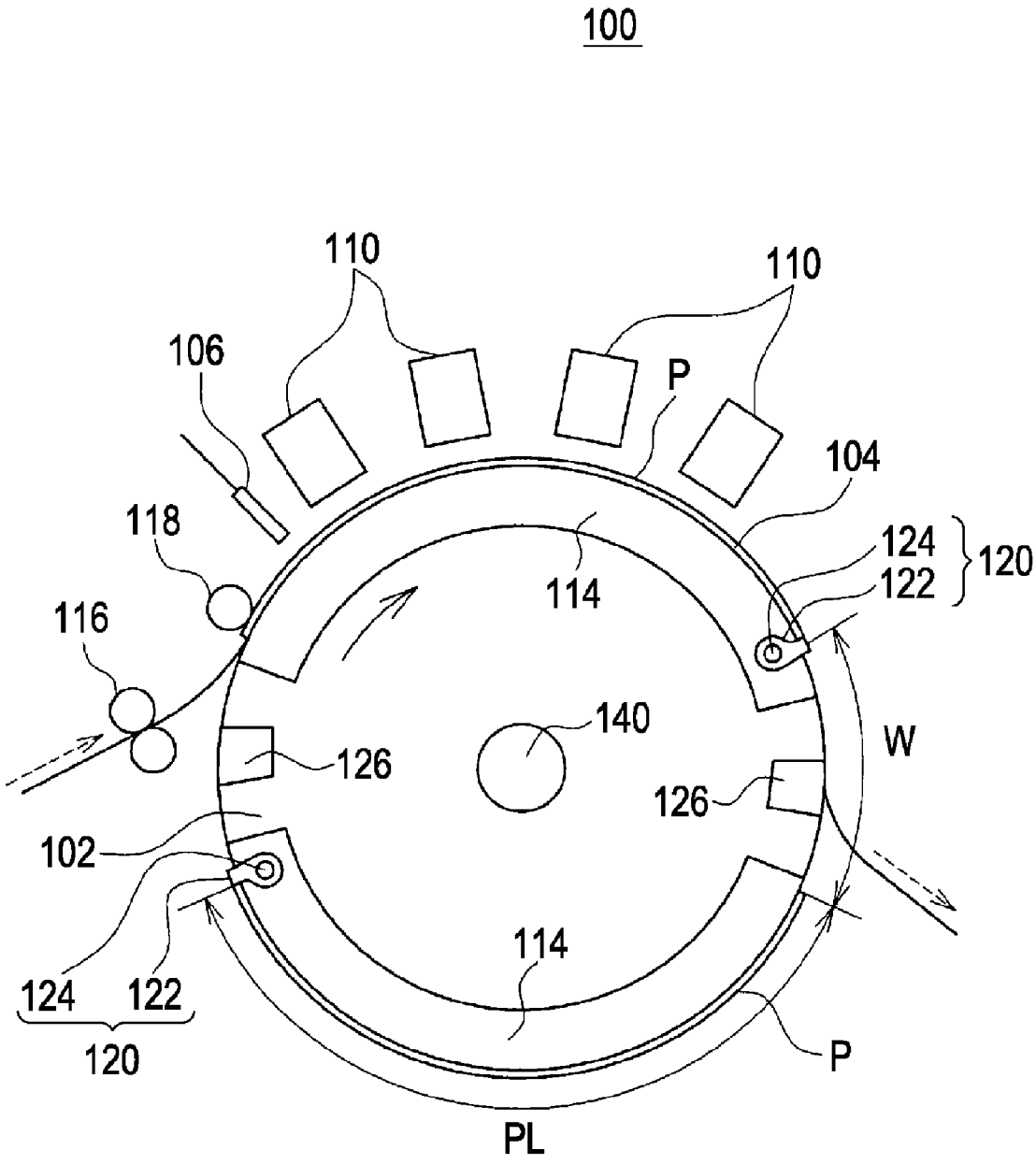
FIG. 1 is a side view illustrating a schematic configuration of a printing apparatus according to an embodiment of the invention.

FIG. 1 is a side view illustrating a schematic configuration of an ink jet printing apparatus 100 according to an embodiment of the invention. As shown in FIG. 1, the printing apparatus 100 is provided with a rotating drum 102 having a cylindrical outer peripheral surface 104, and a plurality of printing heads 110 disposed opposite to the outer peripheral surface 104. A plurality of holes are formed lengthwise and widthwise on the whole of the outer peripheral surface 104. An absorbing portion 114 for performing an absorbing operation through the holes formed on the outer peripheral surface 104 is provided on an inner peripheral side of the rotating drum 102. The absorbing portion 114 generates negative pressure in the holes, and a sheet of paper P is absorbed to the outer peripheral surface 104 by the negative pressure. Accordingly, the sheet of paper P is rotated around a rotating shaft of the rotating drum 102 by rotating the rotating drum 102, and thus the sheet of paper P passes through a position (hereinafter, referred to as a printing position) opposite to the plurality of printing heads 110.

The plurality of printing heads 110 are arranged on the upper side of the rotating drum 102 along the rotating direction of the rotating drum 102. The printing heads 110 eject ink of black (K), cyan (C), magenta (M), and yellow (Y) onto the sheet of paper P absorbed to the outer peripheral surface 104.

Gate rollers 116 are provided on a transport direction upstream side from the rotating drum 102. The gate rollers 116 are provided close to the outer peripheral surface 104 on a side of the rotating shaft of the rotating drum 102. The sheet of paper P is transported to the outer peripheral surface 104 of the rotating drum 102 through the gate rollers 116. A pressing roller 118 is provided on the transport direction downstream side from the gate rollers 116 and on the transport direction upstream side from the printing heads 110. The pressing roller 118 is in press contact with the outer peripheral surface 104, and presses the sheet of paper P to the outer peripheral surface 104.

A paper detecting sensor 106 is provided on the transport direction downstream side from the pressing roller 118 and on the transport direction upstream side from the printing heads 110. When a leading end (rotating direction upstream end) of the sheet of paper P is detected by the paper detecting sensor 106, the printing heads 110 start ejecting ink after a predetermined time.

The rotating drum 102 is provided with a pair of holding portions 120 for pinching the leading end of the sheets of paper P in cooperation with the outer peripheral surface 104. The pair of holding portions 120 are disposed substantially symmetric with respect to the rotating shaft of the rotating drum 102. A distance from one holding portion 120 to the other holding portion 120 along the rotating direction and a distance from the other holding portion 120 to one holding portion 120 along the rotating direction are about ½ of a circumferential length DL of the outer peripheral surface 104. Each of the holding portions 120 is provided with a plurality of pawl members 122 arranged along the width direction of the rotating drum 102.

The pawl member 122 is swingably supported to the shaft member 124. The shaft member 124 is provided on the inner peripheral side of the outer peripheral surface 104. A swing end of the pawl member 122 protrudes from the hole formed on the outer peripheral surface 104 out of the rotating drum 102. A pawl portion bent toward the rotating direction upstream side of the rotating drum 102 is formed at the swing end.

The pawl member 122 is urged toward the rotating direction upstream side of the rotating drum 102, and thus the pawl portion of the pawl member 122 comes into press contact with the outer peripheral surface 104. Accordingly, the leading end of the sheet of paper P is pinched between the pawl portion of the pawl member 122 and the outer peripheral surface 104 in press contact with each other. The pawl member 122 is swung toward the rotating direction downstream side against urging force by a releasing mechanism such as a cam mechanism. Thus, the pawl member 122 is separated from the leading end of the sheet of paper P, thereby releasing the holding of the leading end of the sheet of paper P.

It is assumed that a longitudinal length of a sheet of paper P having the maximum passable size (e.g., A2 size) in the embodiment is PL and a distance between sheets is W. In this case, PL, W, DL, and an integer N satisfy the following Expression (1). However, N is 2 or larger, and N in the embodiment is 2. That is, the circumferential length DL of the outer peripheral surface 104 is set so that N sheets of paper P having the maximum passable size can be arranged with the distance W in the rotating direction.

$$DL > N \times (PL + W) \quad (1)$$

An encoder 140 that outputs an encoder signal based on a rotating phase of the rotating drum 102 is provided on the inner peripheral side of the rotating drum 102. A printing controller for controlling the printing head 110 controls an ejecting timing of ink on the basis of the encoder signal output from the encoder 140.

Figure 2:
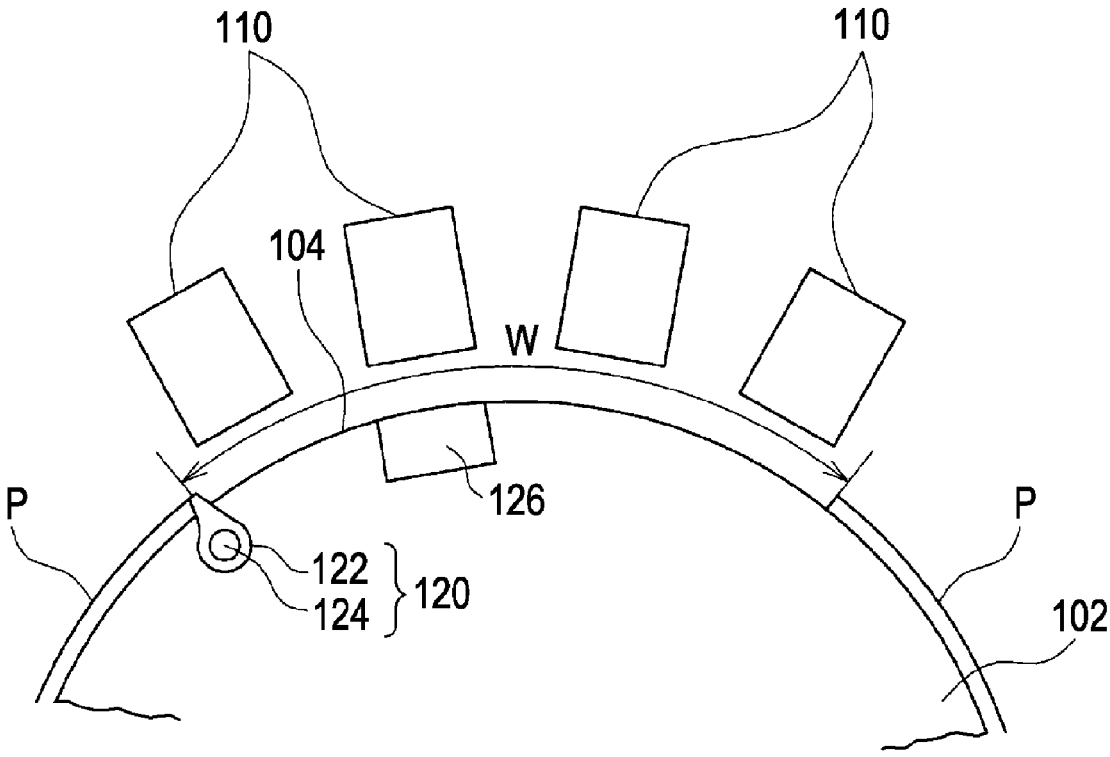
FIG. 2 is a side view illustrating a schematic configuration of an ink receiving portion of the printing apparatus.

The rotating drum 102 is provided with a plurality of ink receiving portions 126. In the embodiment, two ink receiving portions 126 are provided. FIG. 2 shows an enlarged view of the ink receiving portion 126. As shown in FIG. 2, the ink receiving portion 126 is provided from the outer peripheral surface 104 toward the inner peripheral side. A hole open out on the ink receiving portion 126 is formed on the outer peripheral surface 104. With such a configuration, the ink receiving portion 126 is exposed to the outer peripheral surface 104 through the hole. The ink receiving portion 126 is provided with a liquid absorbing member such as a sponge. Ink ejected from the printing head 110 to the ink receiving portion 126 is absorbed into the liquid absorbing member.

The printing head 110 performs a so-called preliminary ejecting operation (flashing) to remove bubbles and high-viscosity ink, before starting a printing operation on the sheet of paper P. The printing head 110 preliminarily ejects ink toward the ink receiving portion 126.

Figure 3A:
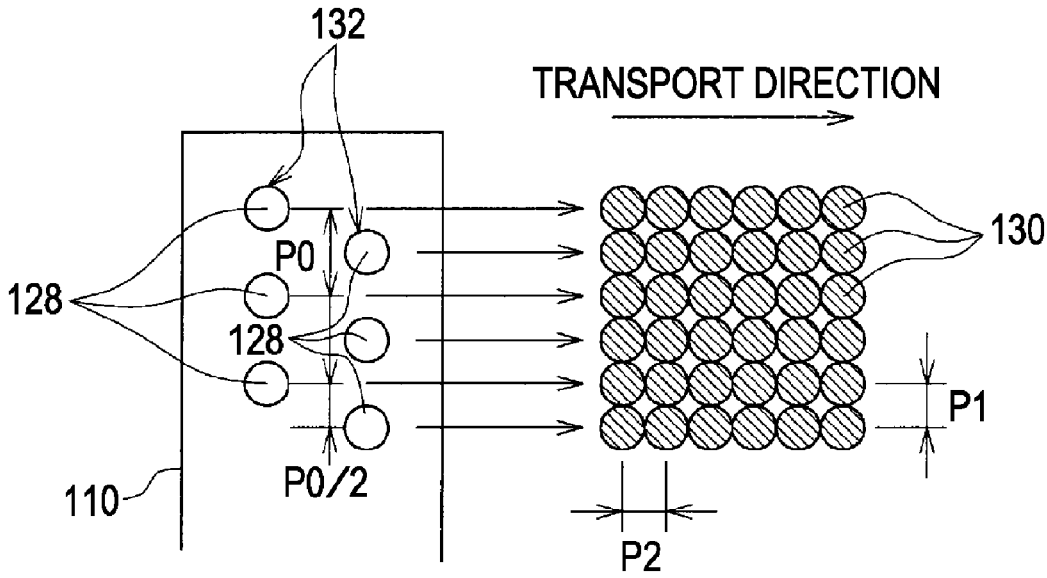
FIG. 3A is a schematic view illustrating arrangement of nozzles in a printing head and arrangement of ink dots in case of solid printing.
Figure 3B:
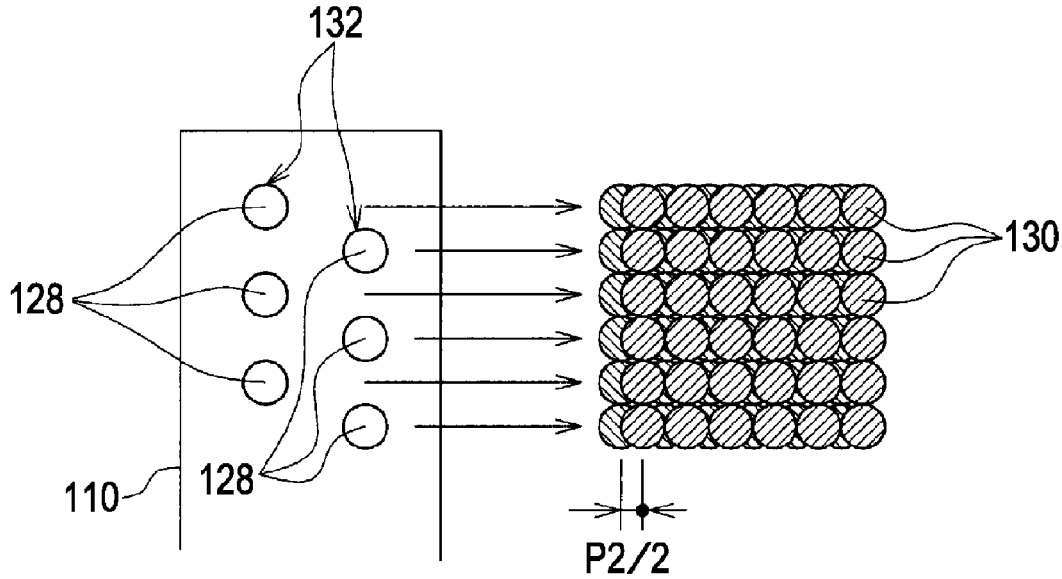
FIG. 3B is a schematic view illustrating arrangement of nozzles in a printing head and arrangement of ink dots in case of solid printing.

FIG. 3A and FIG. 3B are schematic views illustrating arrangement of nozzles 128 in the printing head 110 and arrangement of ink dots 130 in case of solid printing. As shown in FIG. 3A and FIG. 3B, the printing head 110 is provided with nozzle rows 132 formed of a plurality of nozzles 128 arranged in the rotating shaft direction (i.e., paper width direction) of the rotating drum 102. The nozzle rows 132 are arranged in M rows in the rotating direction. M is an integer larger than 1, and M in the embodiment is 2. The nozzles 128 forming the nozzle rows 132 are arranged with a pitch P0 in the paper width direction.

The nozzle rows 132 adjacent in the transport direction are shifted in the paper width direction by P0/M (in the embodiment, P0/2). Accordingly, the printing head 110 forms ink dots 130 with a pitch P1 (=P0/M) smaller than the pitch P0 of the nozzles 128 in the paper width direction.

First, the printing apparatus 100 according to the embodiment transports a sheet of paper P to the rotating drum 102, and the leading end of the transported sheet of paper P is held by the holding portion 120. The printing apparatus 100 transports the sheet of paper P held by the holding portion 120 to the printing position of the plurality of printing heads 110, and performs a printing operation on the sheet of paper P. Then, the printing apparatus 100 rotates the rotating drum 102 without releasing the holding of the leading end of the sheet of paper P held by the holding portion 120. Accordingly, the sheet of paper P is re-transported to the printing position of the plurality of printing heads 110. Then, the printing apparatus 100 performs the printing operation again on the sheet of paper P.

As shown in FIG. 3A, in case of performing the solid printing in which ink are ejected from all the nozzles 128, in a first-pass printing operation, ink dots 130 are formed with the pitch P1 in the paper width direction and with a pitch P2 in the transport direction. In the embodiment, the pitch P1 is equal to the pitch P2.

As shown in FIG. 3B, in the $M^{th}$-pass printing operation, ink dots 130 are formed to be shifted in the rotating direction by P2/M (in the embodiment, P2/2) in the transport direction, from the position of the former-pass printing operation. Accordingly, in the step of completing the $M^{th}$-pass printing operation, it is possible to form the ink dots 130 with a pitch P2/M in the rotating direction. Therefore, it is possible to raise density of the ink dots 130 after the printing operation is completed, without needing to raise density of the ink dots 130 formed in each pass printing operation. Accordingly, it is prevented that ink dots are attached to the sheet of paper P at once with high density and sink into the sheet of paper P, and it is possible to obtain high resolution. Since a printing operation of the same color is performed by one printing head 110, it is possible to prevent decrease in color reproducibility caused by characteristic difference of ink caused when the printing operation of the same color is performed by the plurality of printing heads 110.

While the printing apparatus 100 according to the embodiment performs the first-pass printing operation on the first sheet of paper P, the leading end of which is held by the holding portion 120, the printing apparatus 100 transports the second sheet of paper P to the rotating drum 102. In this case, a distance between the trailing end of the first sheet of paper P and the leading end of the second sheet of paper P is the distance W between sheets.

While rotating the first sheet of paper P on which the first-pass printing operation is performed, the second sheet of paper P is transported to the printing position of the printing heads 110 and a first-pass printing operation is performed on the second sheet of paper P. Then, while rotating the second sheet of paper P on which the first-pass printing operation is performed, the first sheet of paper P is re-transported to the printing position of the printing heads 110 and a second-pass printing operation is performed on the first sheet of paper P.

The holding of the first sheet of paper P by the holding portion 120 and the absorbing of the first sheet of paper P by the absorbing portion 114 are released. Then, the first sheet of paper P is transported toward the transport direction downstream side of the rotating drum 102, the second sheet of paper P is re-transported to the printing position of the printing heads 110, and then a second-pass printing operation is performed on the second sheet of paper P. The holding of the second sheet of paper P by the holding portion 120 and the absorbing of the second sheet of paper P by the absorbing portion 114 are released. Then second sheet of paper P is transported toward the transport direction downstream side of the rotating drum 102, the third sheet of paper P is transported to the rotating drum 102, and then a first-pass printing operation is performed on the third sheet of paper P. Then, the same printing operations as the above-described printing operation of the first and second sheets of paper P are repeated until the continuous printing operation is completed.

As described above, in the embodiment, the rotating drum 102 holds the plurality of sheets of paper P arranged in the rotating direction of the outer peripheral surface 104. Accordingly, while the sheet of paper P first transported by the rotating drum 102 and printed by the printing head 110 is rotated by the rotating drum 102, the subsequent sheet of paper P is transported to the printing position of the printing heads 110 by the rotating drum 102 and the printing operation can be performed on the subsequent sheet of paper P. Therefore, when the sheet of paper P is rotated once or more and is transported to the printing position of the printing heads 110 a plurality of times, it is possible to improve a throughput of the continuous printing operation of a plurality of sheets. When a curvature of the outer peripheral surface 104 of the rotating drum 102 is made low to prevent the sheet of paper P from being detached from the rotating drum 102 by reaction force of the sheet of paper, a circumferential length of outer peripheral surface 104 is extended. However, according to the embodiment, the sheet of paper P is held in the extended space of the outer peripheral surface 104, and thus it is possible to effectively use the extended space of the outer peripheral surface 104.

In the embodiment, the printing head 110 is provided with the plurality of nozzle rows 132 formed of the plurality of nozzles 128 arranged in the paper width direction, in the rotating direction. Accordingly, the printing head 110 ejects ink to the positions shifted in the rotating direction from the ink dots 130 formed in the first-pass printing operation. Therefore, the ink dots 130 become dense to improve resolution, and it is possible to improve a throughput of a continuous printing operation of a plurality of sheets.

Next, another embodiment will be described. The same reference numerals and signs are given to the same elements as those of the above-described embodiment, and the description thereof is omitted.

Figure 4:
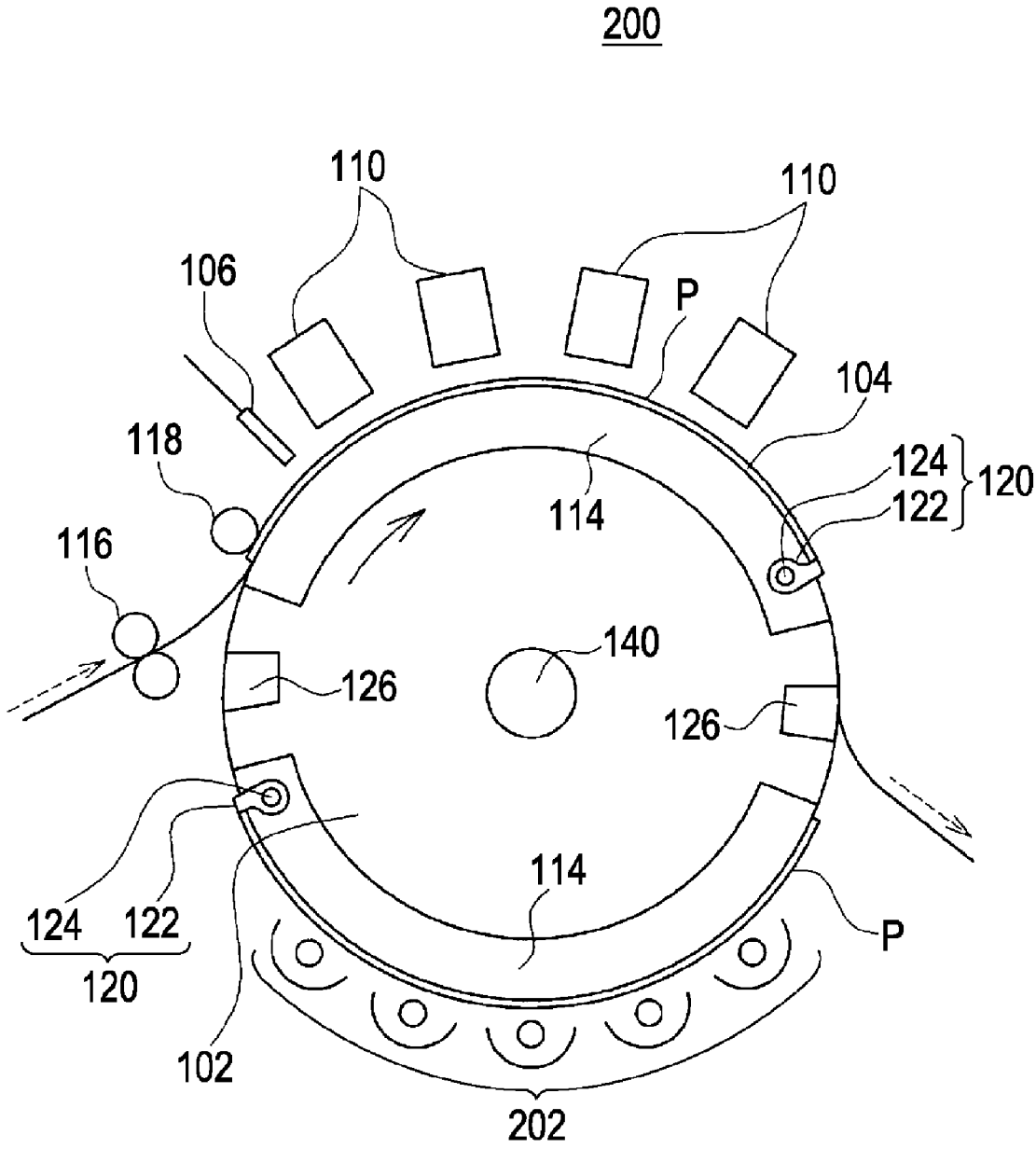
FIG. 4 is a side view illustrating a schematic configuration of a printing apparatus according to another embodiment of the invention.

FIG. 4 is a side view illustrating a schematic configuration of a printing apparatus 200 according to another embodiment of the invention. As shown in FIG. 4, the printing apparatus 200 is provided with a drying portion 202 for drying ink attached to a sheet of paper P. When ink ejected by the printing head 110 contains ultraviolet hardening agent, an example of the drying portion 202 is an ultraviolet lamp.

The drying portion 202 is provided at a position opposite to the printing head 110 with the rotating drum 102 therebetween, that is, on the lower side of the rotating drum 102. The drying portion 202 emits ultraviolet light onto the sheet of paper P attached to the outer peripheral surface 104. Thus, the ultraviolet hardening agent contained in the ink attached to the sheet of paper P is hardened, thereby drying the ink. Accordingly, it is prevented that ink dots sink into the sheet of paper P after the ink dots are attached to the sheet of paper P at the second pass.

In the embodiment, the distance between the drying portion 202 and the printing head 110 along the rotating direction is as long as possible, and the rotating drum 102 is disposed between the drying portion 202 and the printing head 110. With such a configuration, it is possible to prevent a temperature around the printing head 110 from being raised by heat emitted from the drying portion 202, and to prevent the nozzles 128 from being clogged by drying of ink in the printing head 110.

In the embodiment, the drying portion 202 that is the ultraviolet lamp emits ultraviolet light to ink containing ultraviolet hardening agent, thereby drying the ink. However, the drying portion 202 may be, for example, a heater lamp. In this case, ink is heated by the heater lamp so as to vaporize a solvent contained in the ink, thereby drying the ink.

Figure 5:
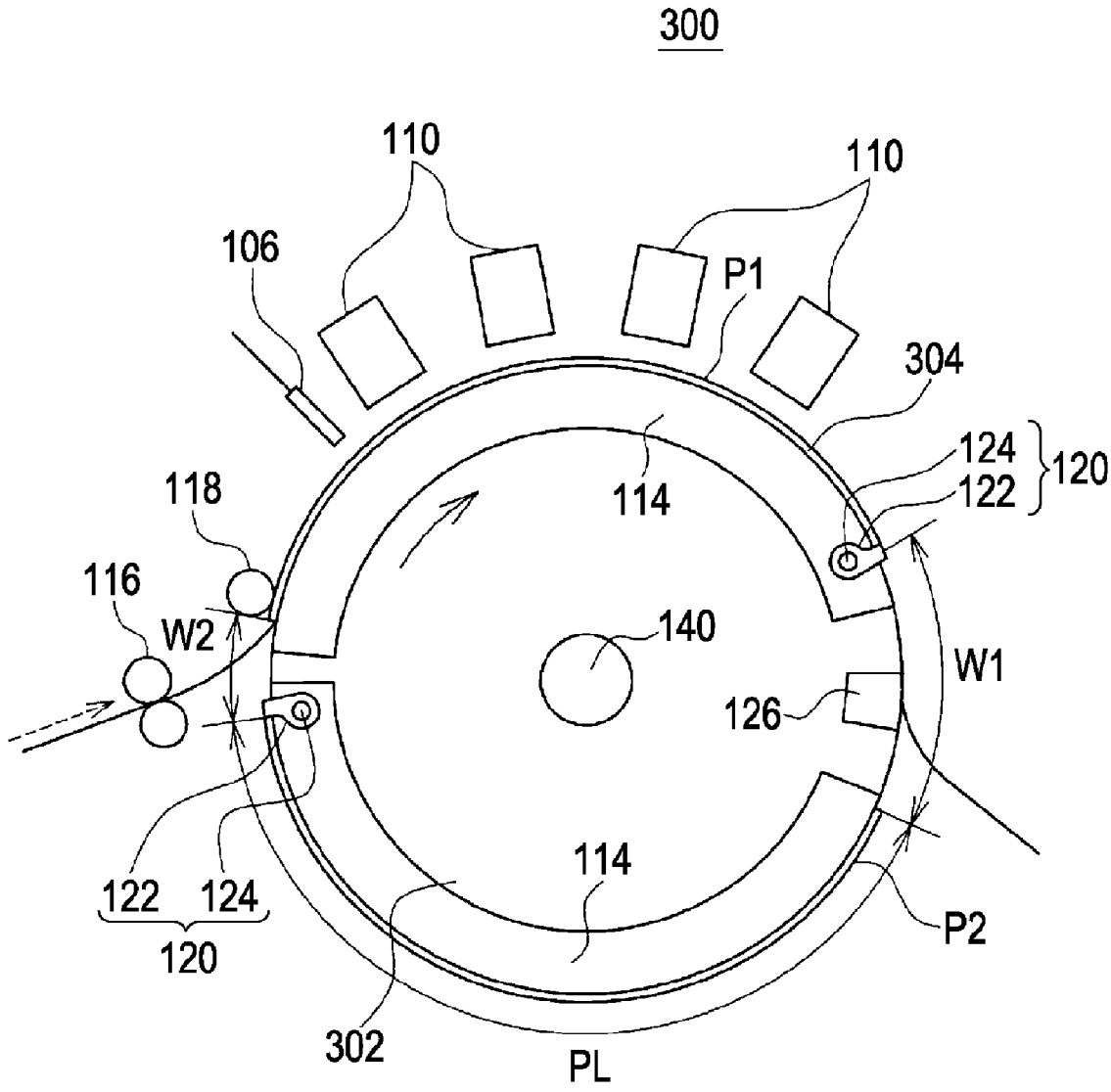
FIG. 5 is a side view illustrating a schematic configuration of a printing apparatus according to another embodiment of the invention.

FIG. 5 is a side view illustrating a schematic configuration of a printing apparatus 300 according to another embodiment of the invention. As shown in FIG. 5, the printing apparatus 300 is provided with a rotating drum 302. The rotating drum 302 rotates and holds a sheet of paper P1 as a first recording medium and a sheet of paper P2 as a second recording medium on an outer peripheral surface 304 thereof.

In the embodiment, a distance W1 between a leading end of the sheet of paper P1 and a trailing end of the sheet of paper P2 is larger than a distance W2 between a leading end of the sheet of paper P2 and a trailing end of the sheet of paper P1. An ink receiving portion 126 is provided between the leading end of the sheet of paper P1 and the trailing end of the sheet of paper P2. With such a configuration, while a portion between the leading end of the sheet of paper P1 and the trailing end of the sheet of paper P2 passes through the printing position of the printing heads 110, it is possible to perform a recovering process for the printing heads 110. Therefore, it is not necessary to interrupt the printing operation during the recovering process, and thus it is possible to improve a throughput of a continuous printing operation of a plurality of sheets.

The distance W1 between the leading end of the sheet of paper P1 and the trailing end of the sheet of paper P2 is provided to have a width capable of securing a space for installing the ink receiving portion 126, and the distance W2 between the leading end of the sheet of paper P2 and the trailing end of the sheet of paper P1 is provided to have a width as much as a space for installing the ink receiving portion 126 is not necessary. With such a configuration, it is possible to reduce the circumferential length of the rotating drum 102, thereby reducing the size of the rotating drum 102.

The invention has been described above with reference to the embodiments, but the technical scope of the invention is not limited to the scope described in the embodiments. The embodiments may be variously modified or improved. The technical scope of the invention includes such a modification or improvement.

What is claimed is:

1. A printing apparatus comprising:

a rotating drum that holds a recording medium on a cylindrical outer peripheral surface thereof and rotates around a rotating shaft;

a printing head that is disposed opposite to the outer peripheral surface of the rotating drum and ejects ink onto the recording medium held on the rotating drum to perform a printing operation;

wherein the rotating drum comprises an ink receiving portion that includes a liquid absorbing member that receives ink preliminarily ejected from the printing head, wherein the rotating drum holds a first recording medium and a second recording medium arranged in a rotating direction, wherein a distance between a rotating direction downstream end of the first recording medium and a rotating direction upstream end of the second recording medium is larger than a distance between a rotating direction downstream end of the second recording medium and a rotating direction upstream end of the first recording medium, and wherein the liquid absorbing member is provided between the rotating direction downstream end of the first recording medium and the rotating direction upstream end of the second recording medium.

2. The printing apparatus according to claim 1, wherein the rotating drum is provided with a pair of holding portions pinching leading ends of the first recording medium and the second recording medium in cooperation with the outer peripheral surface, wherein each of the pair of holding portions is provided with a shaft member disposed on the inner peripheral side of the outer peripheral surface, and a plurality of pawl members swingably supported to the shaft member and arranged along a width direction of the rotating drum, and wherein end portions of the plurality of pawl members protrude from holes formed on the outer peripheral surface out of the rotating drum, are bent toward the rotating direction upstream side of the rotating drum, and are urged toward the rotating direction upstream side of the rotating drum.

* * * * *